US007677949B1

(12) United States Patent
Mc Millan

(10) Patent No.: US 7,677,949 B1
(45) Date of Patent: Mar. 16, 2010

(54) CONSTRUCTION KIT FOR CONSTRUCTING A PLAY STRUCTURE

(76) Inventor: Arthur G. Mc Millan, 1954 W. Grand, Apt. #4, Dayton, OH (US) 45407

( * ) Notice: Subject to any disclaimer, the term of this patent is extended or adjusted under 35 U.S.C. 154(b) by 824 days.

(21) Appl. No.: 11/549,432

(22) Filed: Oct. 13, 2006

(51) Int. Cl.
*A63H 3/52* (2006.01)
*A63H 3/00* (2006.01)

(52) U.S. Cl. ..... 446/476; 446/478; 472/136; 482/35

(58) Field of Classification Search ..... 472/116, 472/117, 128, 129, 136; 446/476, 478, 479–482, 446/487, 85, 97, 106, 117; 482/35, 36, 78; 52/233, 272, 668
See application file for complete search history.

(56) References Cited

U.S. PATENT DOCUMENTS 655,255 A * 8/1900 Lyouns ..... 52/28
895,176 A * 8/1908 Gaynor ..... 472/136
1,801,724 A * 4/1931 Conklin ..... 434/72
2,817,924 A * 12/1957 Schrader ..... 446/423
2,883,192 A * 4/1959 Royston ..... 482/36
3,653,146 A * 4/1972 Goldfarb ..... 446/113
4,077,152 A * 3/1978 Newsom et al. ..... 446/476
4,262,900 A * 4/1981 Vinson ..... 482/36
4,332,116 A 6/1982 Buchanan
5,226,864 A * 7/1993 Showers ..... 482/35
5,326,328 A 7/1994 Robinson
D372,757 S 8/1996 Martin et al.
5,697,851 A 12/1997 Delgado
5,881,515 A * 3/1999 George ..... 52/233
6,099,411 A * 8/2000 Van Wagenen ..... 472/136
6,174,242 B1 * 1/2001 Briggs et al. ..... 472/136
6,231,451 B1 * 5/2001 Briggs ..... 472/128
6,250,021 B1 6/2001 Ferrara, Jr.
2002/0193046 A1 12/2002 Zebersky

* cited by examiner

*Primary Examiner*—Kien T Nguyen
(74) *Attorney, Agent, or Firm*—Advantia Law Group; Michael W. Starkweather

(57) ABSTRACT

A construction kit for constructing a play structure. The play structure for providing children a place to play includes: a square-shaped, planar horizontal support member; plurality of legs; an octagonal-shaped, concave floor member; an octagonal-shaped, planar floor member; a plurality of vertical support members; a substantially convex ceiling member; two staircases; and a flag pole, removably coupleable to a top side of the ceiling member, and configured to hang a flag thereon.

13 Claims, 3 Drawing Sheets

CONSTRUCTION KIT FOR CONSTRUCTING A PLAY STRUCTURE

BACKGROUND OF THE INVENTION

1. Field of the Invention

The present invention relates to construction kits, specifically a construction kit for constructing a play structure.

2. Description of the Related Art

In the related art it has been known to use structures whereupon children may engage in recreation safely. Different themed structures have been used to attract the interest of children and further enable them to engage in imaginative and fun-filled recreation. There is a need for attractive, safe, affordable and versatile structures whereupon children may recreate. Some improvements have been made in the field. Examples include but are not limited to the references described below, which references are incorporated by reference herein:

U.S. Pat. No. 5,326,328, issued to Robinson, discloses a plastic building element is described which permits a variety of play structures to be assembled. The main building element is a dish-shaped molded plastic part, having a bottom, integral lower side walls projecting generally upwardly from the outer periphery of the bottom to define a lower portion of one nominal diameter, integral generally horizontal portions projecting outwardly from the top of the lower side walls, and integral upper side walls projecting generally upwardly from the outer periphery of the horizontal portion to define an upper portion having a substantially larger nominal diameter. Preferably, the side walls are defined by a number of generally rectangular panels defining a polygonal shape for the building element as viewed in horizontal section. In the preferred embodiment, the structure is hexagonal. The building element can be used in its simplest application as a children's sandbox, or assembled to define play cavities in the form of more elaborate structures such as a "spaceship" or a "gumball machine".

U.S. Pat. No. 6,250,021, issued to Ferrara, discloses a device starting from flat partly assembled components, this shelter, when erected, includes tubular roof-reinforcing and attachment beams disposed against roof segments and sidewalls.

U.S. Pat. No. 4,332,116, issued to Buchanan, discloses a building, constructed from prefabricated building components, where the roof and floor components are formed from substantially similar triangle-shaped components. The roof and floor components are sequentially assembled and integrally fastened to the center support column of the building, so that the plan view of the building structure has the form of a polygon. The floor components are each supported at the perimeter of the polygon by vertically adjustable support columns which allow for construction of the building on uneven terrain with minimum site preparation. The roof components are supported at the perimeter of the polygon by fixed vertical posts, between which posts may be included structural prefabricated wall components.

U.S. Pat. No. 5,697,851, issued to Delgado, discloses a portable playground system including a cylindrical base member having four openings therethrough disposed at ninety degree intervals therearound intermediate upper and lower ends thereof. The base member has a floor disposed interiorly thereof disposed at lower ends of the four openings. A top member is dimensioned for removable coupling with the upper end of the cylindrical base member. Stairs, ladders and slides are adapted for removably coupling with the four openings.

U.S. Patent Application Publication No.: US 2002/0193046, by Zebersky, discloses a modular house toy includes a fixed supporting structure made of a solid floor, a solid ceiling, a solid back wall connecting the floor to the ceiling, and an open arch connecting the floor to the ceiling. The back wall and/or the arch permanently connect the floor to the ceiling in respective connection planes. A modular house toy configuration includes at least two fixed supporting structures. One fixed supporting structure is removably connected to another in six positions. Preferably, the floor and the ceiling have the same shape and the back wall and the arch have the same shape to allow repetitious and modular interlocking of one modular house toy to another module house toy. Wall and arch extensions are inserted into floor depressions and other wall and arch extensions are inserted into ceiling depressions to connect the floor to the ceiling.

U.S. Design Pat. No.: 372,757, issued to Martin et al., discloses the ornamental design for an activity gym.

The inventions heretofore known suffer from a number of disadvantages which include unappealing, expensive and/or limited in use.

What is needed is a construction kit that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available construction kits. Accordingly, the present invention has been developed to provide a construction kit for constructing a play structure.

In one embodiment, there is a construction kit for constructing a play structure that may provide children a place to play. The construction kit may include: a horizontal support member that may be substantially planar and/or square-shaped; a plurality of legs that may be removably coupleable to a bottom side of the horizontal support member, and/or may extend downwardly therefrom; a first floor member that may be octagonal in shape, and/or may be removably coupleable to a top side of the horizontal support member, and/or may be substantially concave from a top perspective; a plurality of first vertical support members, wherein each may be removably coupleable to an edge of the first floor member, and/or may extend upwardly therefrom; a second floor member that may be octagonal in shape, and/or may be removably coupleable to an end of the first vertical support members opposite the first floor member, and/or may be substantially planar.

An embodiment of the construction kit may also include: a second vertical support member, wherein the second vertical support member may be removably coupleable to an edge of the second floor member, and/or may extend upwardly therefrom; and/or a ceiling member that may be removably coupleable to an end of the second vertical support member opposite the second floor member, an/or may be substantially convex from a top perspective.

The kit may further include: a first staircase that may be removably coupleable to the second floor member and/or the first floor member; and/or a second staircase that may be removably coupleable to the first floor member and/or extend downwardly therefrom; a flag pole that may be removably coupleable to a top side of the ceiling member and/or may extend outwardly therefrom, and/or may be configured to hang a flag thereon.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
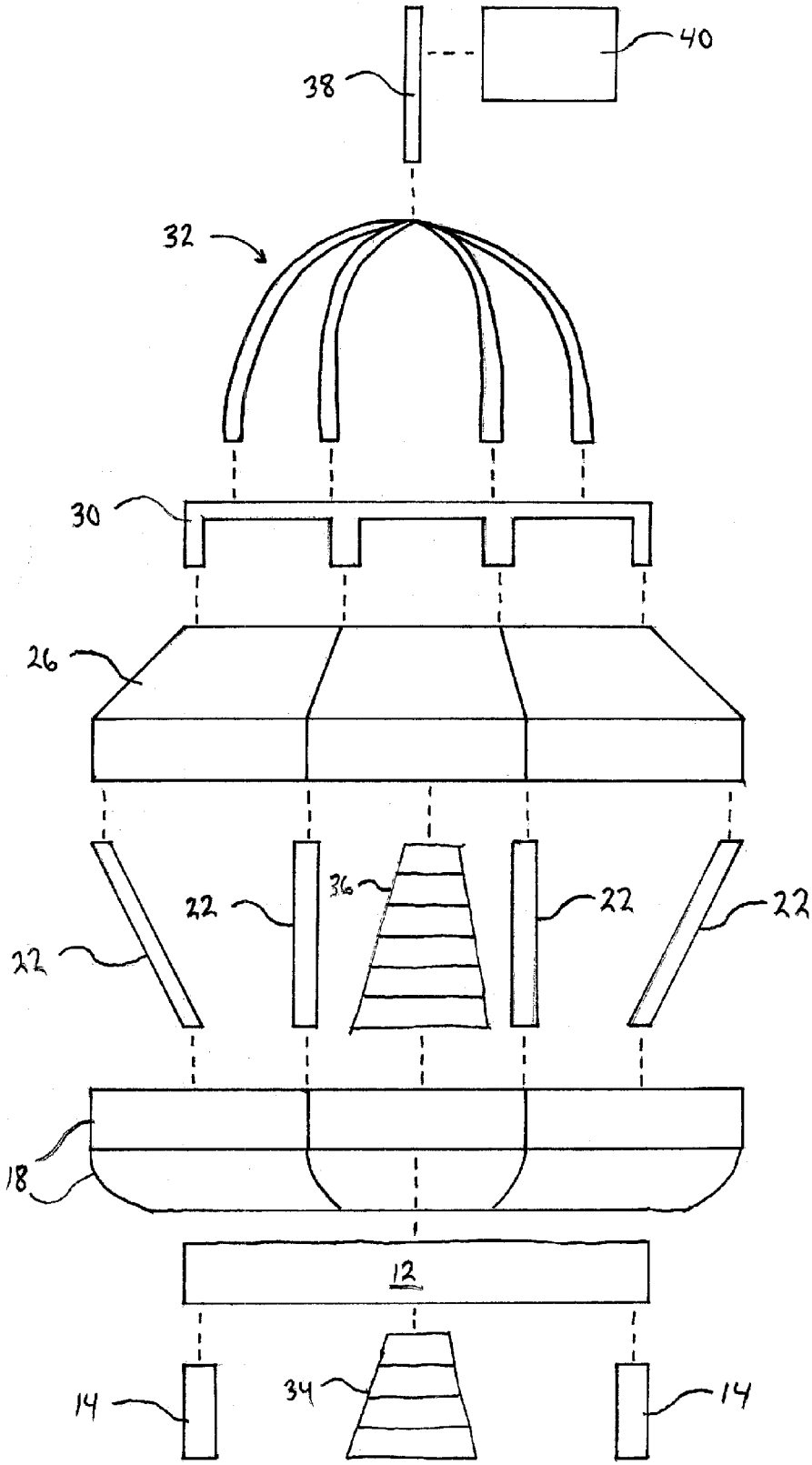
FIG. 1 is a front elevational view of a construction kit; according to one embodiment.
Figure 2:
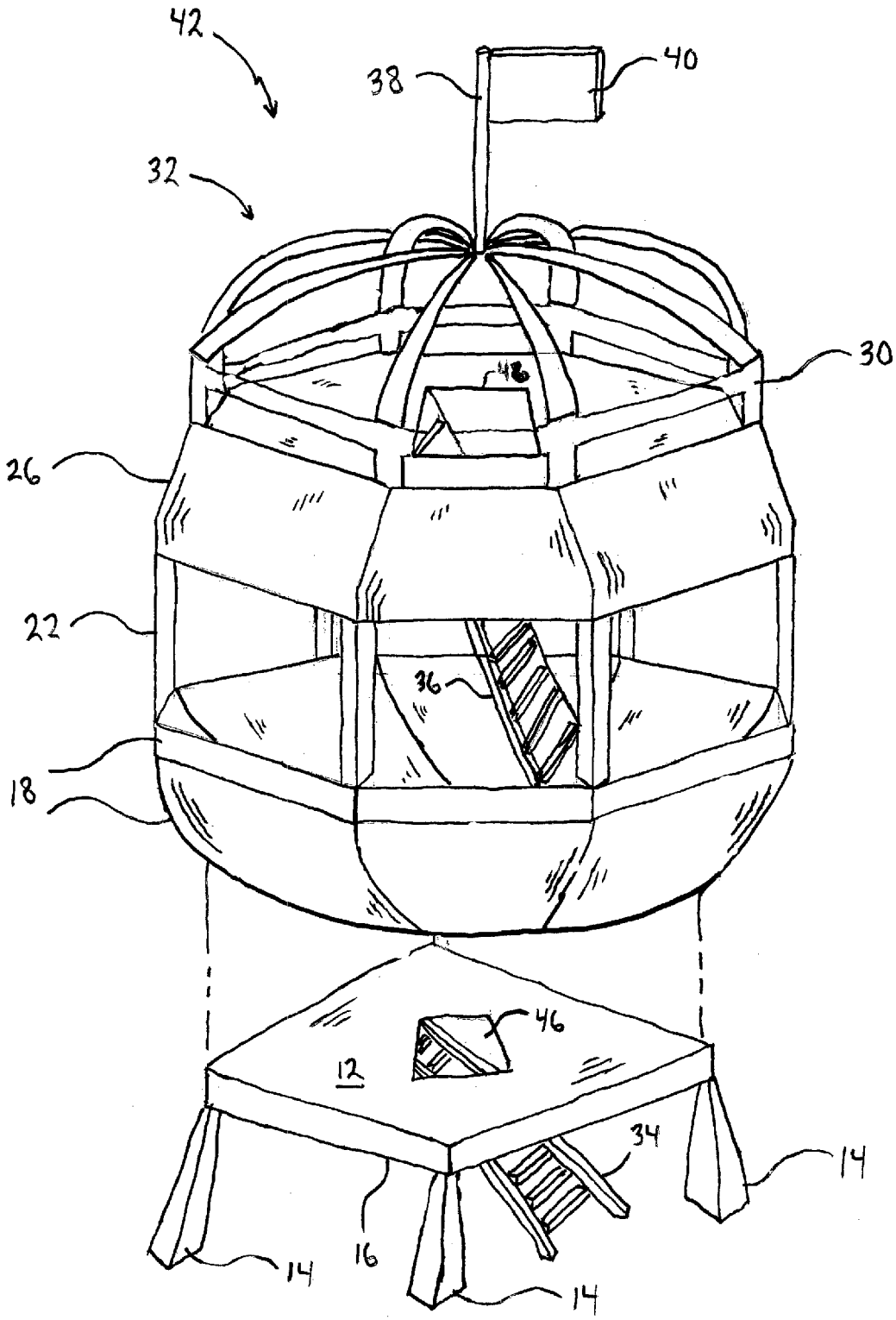
FIG. 2 is perspective view of a play structure; according to one embodiment.
Figure 3:
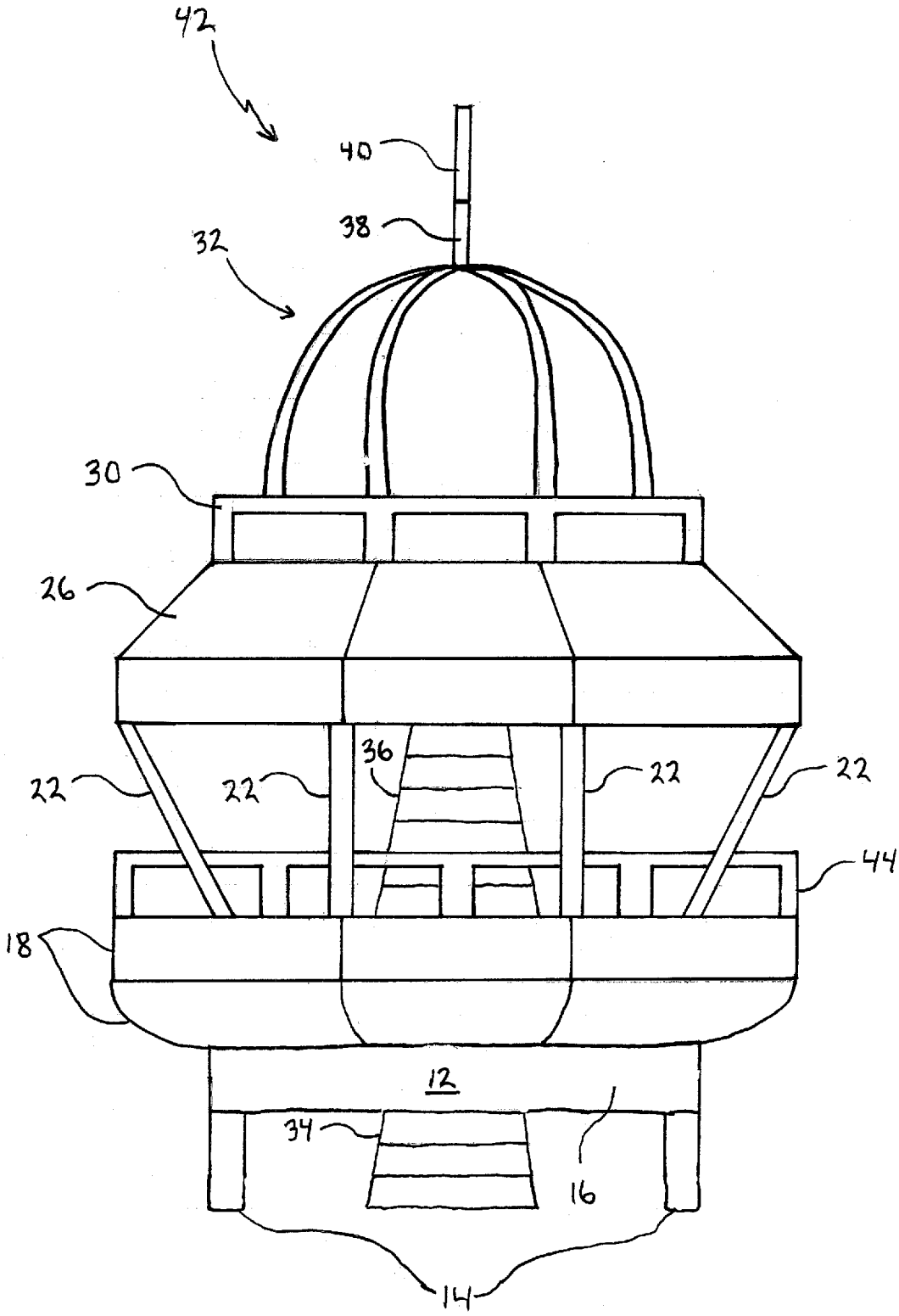
FIG. 3 is a side elevational view of a play structure; according to one embodiment.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

Looking to the figures, there is a construction kit 10 for constructing a play structure 42 that may provide children a place to play. The illustrated construction kit include the following pieces: a square-shaped horizontal support member 12 that is substantially planar; a plurality of legs 14 removably coupleable to a bottom side 16 of the horizontal support member, and extends downwardly therefrom; a first octagonal-shaped floor member 18 removably coupleable to a top side 20 of the horizontal support member, and is substantially concave from a top perspective; a plurality of first vertical support members 22 removably coupleable to an edge 24 of the first floor member, and extends upwardly therefrom; a second octagonal-shaped floor member 26 removably coupleable to an end 28 of the first vertical support members opposite the first floor member. In addition, the second floor member may be substantially planar. Moreover, a user may couple the first octagonal floor member 18 to the top side 20 of horizontal support member 12 prior to coupling the legs 14 to the bottom side bottom side 16 of the horizontal support member 12.

An embodiment of the construction kit 10 may also include: a second vertical support member 30 removably coupleable to an edge 24 of the second floor member, and extends upwardly therefrom; and ceiling member 32 removably coupleable to an end 28 of the second vertical support member opposite the second floor member. The ceiling member is substantially convex from a top perspective.

An embodiment of the construction kit 10 may further include: a first staircase 34 removably coupleable to the second floor member 26 and first floor member 18; and a second staircase 36 removably coupleable to floor member 18 and extends downwardly therefrom; a flag pole 38 removably coupleable to a top side of the ceiling member and/or may extend outwardly therefrom, and/or may be configured to hang a flag 40 thereon.

In operation, a child may climb up the staircase 34 through opening 46, into the first concave floor member 18 to play therein. If the child desires to play on the second floor in the play structure 42, he or she can climb up staircase 36, through the opening 46 in the second floor member 26. There is a rigid safety rail 30 fixedly attached to the top side 48 of the second floor member, and encompasses such. This rail is positioned to prevent the child from falling off the play structure and injuring him or herself. In addition the play structure is support by rigid horizontal support member 12 with a plurality of rigid legs 14 fixedly attached to the bottomside of there support member, thereby providing a strong foundation need to keep the play structure erect. Further, the play structure also includes ceiling member 32 in the form of a barred observatory, allowing the child to observe the outside surroundings from the second floor. There is also a flag pole 38 removably attached to the ceiling member 32, and having a flag 40 removably attached thereon, thereby enhancing the appearance of the play structure.

The embodiment of the construction kit used to build the play structure 42 for providing children a place to play offers children with an alternative to the standard houses and play forts found at home and playgrounds. With the embodiment of the present invention in the form of a space ship, children could pretend that they are astronauts or aliens through outer space. The play structure 42 is ideal for use at schools, parks, playgrounds, etc.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

Although, the figures illustrate floor members 18, 26 being octagonal in shape; the horizontal support member 12 and vertical support members 22, 30 being squared-shaped; and legs 14 being cylindrical in shape, one skilled in the art would know that floor members, horizontal support members, vertical support members, and/or legs may vary in shape according to different embodiments. For example, hexagonal, rectangular, triangular, etc.

Additionally, although the figures illustrate the ceiling member 32 being convex and floor member 18 being concave, the ceiling member and/or floor member may be constructed in different shapes. For example, pentagonal, cubical, rectangular, etc.

It is also envisioned that the height of the play structure 42 may vary according to various embodiments.

It is expected that there could be numerous variations of the design of this invention. An example is that the floor members 18, 26; horizontal support member 12; vertical support members 22, 30; legs 14; ceiling member 32; stair cases 34, 36; and flag pole 38 may vary in length, width, circumference, and/or size.

Finally, it is envisioned that the components of the device may be constructed of a variety of materials. For example, metal, metal alloys, plastic, composite material, etc.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A construction kit for constructing a play structure, comprising:

a) a horizontal support member, wherein the horizontal support member is substantially planar;

b) a plurality of legs, removably coupleable to a bottom side the horizontal support member, and extending downwardly therefrom;

c) a first floor member, removably coupleable to a top side of the horizontal support member, wherein the first floor member is substantially concave from a top perspective;

d) a plurality of first vertical support members, each removably coupleable to an edge of the first floor member and extending upwardly therefrom;

e) a second floor member, removably coupleable to an end of the first vertical support members opposite the first floor member, wherein the second floor member is substantially planar;

f) a second vertical support member, removably coupleable to an edge of the second floor member, and extending upwardly therefrom; and g) a ceiling member, removably coupleable to an end of the second vertical support member opposite the second floor member, wherein the ceiling member is substantially convex from a top perspective.

2. The construction kit of claim 1, further comprising:

a) a first staircase, removably coupleable to the second floor member and the first floor member; and b) a second staircase, removably coupleable to the first floor member and extending downwardly therefrom.

3. The construction kit of claim 2, wherein a circumference of the first floor member is octagonal, a circumference of the second floor member is octagonal, and the circumference of the first floor member is substantially aligned with the circumference of the second floor member.

4. The construction kit of claim 3, wherein a circumference of the horizontal support member is square.

5. The construction kit of claim 4, further comprising:

a) a flag pole, removably coupleable to a top side of the ceiling member and extending outwardly therefrom, and configured to hang a flag thereon.

6. A construction kit for constructing a play structure, consisting essentially of:

a) a horizontal support member, wherein the horizontal support member is substantially planar;

b) a plurality of legs, removably coupleable to a bottom side the horizontal support member, and extending downwardly therefrom;

c) a first floor member, removably coupleable to a top side of the horizontal support member, wherein the first floor member is substantially concave from a top perspective;

d) a plurality of first vertical support members, each removably coupleable to an edge of the first floor member and extending upwardly therefrom;

e) a second floor member, removably coupleable to an end of the first vertical support members opposite the first floor member, wherein the second floor member is substantially planar;

f) a second vertical support member, removably coupleable to an edge of the second floor member, and extending upwardly therefrom; and g) a ceiling member, removably coupleable to an end of the second vertical support member opposite the second floor member, wherein the ceiling member is substantially convex from a top perspective.

7. The construction kit of claim 6, wherein a circumference of the first floor member is octagonal, a circumference of the second floor member is octagonal, and the circumference of the first floor member is substantially aligned with the circumference of the second floor member.

8. The construction kit of claim 7, wherein a circumference of the horizontal support member is square.

9. A play structure for providing children a place to play, comprising:

a) a horizontal support member, wherein the horizontal support member is substantially planar;

b) a plurality of legs, coupled to a bottom side the horizontal support member, and extending downwardly therefrom;

c) a first floor member, coupled to a top side of the horizontal support member, wherein the first floor member is substantially concave from a top perspective;

d) a plurality of first vertical support members, each coupled to an edge of the first floor member and extending upwardly therefrom;

e) a second floor member, coupled to an end of the first vertical support members opposite the first floor member, wherein the second floor member is substantially planar;

f) a second vertical support member, coupled to an edge of the second floor member, and extending upwardly therefrom; and g) a ceiling member, coupled to an end of the second vertical support member opposite the second floor member, wherein the ceiling member is substantially convex from a top perspective.

10. The play structure of claim 9, further comprising:

a) a first staircase, coupled to the second floor member and the first floor member; and b) a second staircase, coupled to the first floor member and extending downwardly therefrom.

11. The play structure of claim 10, wherein a circumference of the first floor member is octagonal, a circumference of the second floor member is octagonal, and the circumference of the first floor member is substantially aligned with the circumference of the second floor member.

12. The play structure of claim 11, wherein a circumference of the horizontal support member is square.

13. The play structure of claim 12, further comprising:

a) a flag pole, coupled to a top side of the ceiling member and extending outwardly therefrom, and configured to hang a flag thereon.

* * * * *